US008022322B2

(12) United States Patent
Yamada et al.

(10) Patent No.: US 8,022,322 B2
(45) Date of Patent: Sep. 20, 2011

(54) KEY SWITCH ARRANGEMENT EXCELLENT IN WATERPROOFING PROPERTY

(75) Inventors: Shigeru Yamada, Gunma (JP); Yasushi Takagi, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 433 days.

(21) Appl. No.: 12/232,836

(22) Filed: Sep. 25, 2008

(65) Prior Publication Data

US 2009/0133999 A1 May 28, 2009

(30) Foreign Application Priority Data

Nov. 28, 2007 (JP) ..... 2007-306742

(51) Int. Cl.
*H01H 13/06* (2006.01)

(52) U.S. Cl. ..... 200/302.2

(58) Field of Classification Search ..... 200/302.2, 200/345, 302.1, 341, 314, 512, 293
See application file for complete search history.

(56) References Cited

U.S. PATENT DOCUMENTS

| | | | | |
|---|---|---|---|---|
| 4,020,328 | A | 4/1977 | Bradam | |
| 5,300,742 | A * | 4/1994 | Huang | 200/302.2 |
| 6,610,944 | B2 * | 8/2003 | Lee et al. | 200/302.1 |
| 7,351,928 | B2 * | 4/2008 | Harada | 200/302.1 |
| 2005/0224326 | A1 * | 10/2005 | Oikawa | 200/302.1 |

FOREIGN PATENT DOCUMENTS

| | | |
|---|---|---|
| JP | 10-222267 | 8/1998 |
| JP | 2001-229764 | 8/2001 |
| JP | 2002-216575 | 8/2002 |
| JP | 2002-216576 | 8/2002 |

* cited by examiner

*Primary Examiner* — Edwin A. Leon
(74) *Attorney, Agent, or Firm* — Rabin & Berdo, PC

(57) ABSTRACT

A key switch arrangement is able to prevent liquid such as water from entering a membrane sheet and staying therein. The key switch arrangement includes a waterproof sheet arranged above the membrane sheet, a first fixing member arranged in above the waterproof sheet and having a first projection protruding on the side of the waterproof sheet, and a second fixing member arranged below the membrane sheet and having a second projection protruding on the side of the membrane sheet. In the waterproof sheet and the second projection, holes are formed to which the first projection enters, while in the membrane sheet, a hole is formed to which the second projection enters so as to adhere the waterproof sheet closely to the second projection.

6 Claims, 5 Drawing Sheets

KEY SWITCH ARRANGEMENT EXCELLENT IN WATERPROOFING PROPERTY

BACKGROUND OF THE INVENTION

1. Field of the Invention

The present invention relates to a key switch arrangement of a keyboard serving as an input device for use in information processing equipment, measuring apparatuses, medical instruments, etc., specifically excellent in waterproofing property.

2. Description of the Background Art

In general, a keyboard for use in a portable personal computer or the like is arranged to secure operability such that a key-top descends, when depressed at any portion thereof, without being inclined. For this aim, a conventional key switch arrangement has link mechanism provided under the key-top. Such a switch arrangement having the link mechanism provided under the key-top is disclosed, for example, by Japanese patent laid-open publication No. 2001-229764.

Reference will be first be made to FIG. 5 for describing a conventional key switch arrangement having link mechanism for better understanding a key switch arrangement according to the invention. In FIG. 5, a conventional key switch 10 comprises a key-top 11, a first link member 12 arranged rotatably against the key-top 11, a second link member 13 arranged slidably against the key-top 11, a rubber dome 14 functioning as an elastic member bendable when the key-top 11 is depressed and restoring the key-top 11 to its original position when the depression is released, a holder 15 for holding the first and second link members 12 and 13, a membrane sheet 16 having a contact 16*a* right under the rubber dome 14, and a back plate 17 with which the holder 15 is fixed. The first link member 12 and the second link member 13 constitute the link mechanism.

The back plate 17 has an embossed portion 17*a* formed to protrude upward, which enters a through-hole 16*b* formed in the membrane sheet 16. In the lower part of the holder 15 there is formed a welding pin 15*a*, which is arranged to enter a hole 17*b* formed in the embossed portion 17*a* of the back plate 17. The back plate 17 is welded to the holder by intervention of the membrane sheet 16 in a state of the welding pin 15*a* having entered the hole 17*b*.

In the key switch arrangement described above, even when an edge part of the key-top 11 is depressed, the key-top 11 descends while keeping itself horizontal thanks to the link mechanism consisted of the first and second link members 12, 13. For example, when an edge of the key-top 11 shown in FIG. 5 with an arrow A is depressed, the right edge of the first link member 12 descends first and the left edge of the first link member 12 moves leftward in the figure. Thereby, the central part of the first link member 12 descends, and thus, the second link member 13 also descends which is linked with the first link member 12 in the central part. As the second link member 13 descends, the left edge of the key-top 11 also descends. In this way, even when an edge of the key-top 11 is depressed, the key-top 11 descends while keeping itself in its horizontal position, thereby eliminating difference in operational feeling due to depressing location, i.e. securing operability.

Moreover, in preparation for the case where an operator spills liquid over the keyboard by accident during operation of the key switches, a prior art keyboard device has been improved to be equipped with waterproofing property. Such a keyboard is disclosed, for example, by another Japanese patent laid-open publication No. 2002-216575. The keyboard device disclosed by the publication has a membrane sheet, on which there is provided a waterproof sheet having waterproof walls around it, so that a circuit board and others in the lower part of the keyboard are not influenced, even when liquid is spilled over the keyboard by accident.

However, in recent years, a progress in keyboards has been accelerated in respect of thinning and downsizing, which makes it difficult to secure a sufficient gluing width in a single membrane sheet. For this reason, in a prior art key switch arrangement, when spilled liquid has been left for a long period of time, the liquid enters the key switch structure through a glued portion of the membrane sheet. More specifically, as shown in FIG. 5 with an arrow B, in the through-hole 16*b* of the membrane sheet 16, liquid possibly enters between the periphery of the embossed portion 17*a* of the back plate 17 and the membrane 16.

On the other hand, in the key switch arrangement provided with a waterproof sheet, when a resin film or other material is molded on the waterproof sheet to then form waterproof walls around it, the waterproof sheet tends to be thicker. In the keyboard with accelerated thinning and downsizing, as a rubber dome presses the waterproof sheet in the upper part of a contact at the time when a key is depressed, it tends to take time from the start depression of a key-top till the closing of the contact. In order to avoid that, the keyboard disclosed by above '764 Japanese publication has a recess formed on the waterproof sheet above the contact. However, when water stays in the recess for a long period of time, water possibly immerses into the membrane sheet, depending on the condition of the gluing width of the membrane.

SUMMARY OF THE INVENTION

It is an object of the present invention to provide a key switch arrangement capable of preventing liquid from entering a membrane sheet as well as from staying therein.

In accordance with the present invention, a key switch arrangement including a key-top depressable to close an electric contact provided on a membrane sheet comprises a waterproof sheet arranged above the membrane sheet, a first fixing member arranged above the waterproof sheet and having a first projection protruding toward the waterproof sheet, and a second fixing member arranged below the membrane sheet and having a second projection protruding toward the membrane sheet, each of the waterproof sheet and the second projection having a hole formed to accept the first projection, the membrane sheet having a hole to accept the second projection, thereby adhering the waterproof sheet closely to the second projection.

Further, in accordance with another invention, a key switch arrangement including a key-top depressable to close an electric contact provided in the membrane sheet comprises a first fixing member arranged above the membrane sheet and having a first projection protruding toward the membrane sheet, and a second fixing member arranged below the membrane sheet and having a second projection protruding toward the membrane sheet, the membrane sheet having an upper sheet, each of the upper sheet and the second protrusion having a hole to accept the first projection, the membrane sheet having a spacer sheet and a lower sheet, each of the spacer sheet and the lower sheet having a hole formed to accept the second projection, thereby adhering the upper sheet closely to the second projection.

In accordance with the present invention, since the upper part of a membrane sheet is covered with the waterproof sheet and the hole for fixing the waterproof sheet is closely adhered with the first fixing member and the first projection of the first fixing member, liquid does not enter the membrane sheet. Further, since the first fixing member has the drain groove formed therein, liquid is discharged outside the first fixing member, and therefore, liquid does not stay in the upper part of the membrane for a long period of time.

According to one aspect of the present invention, since close adhesion is made with the first fixing member and the second projection of the second fixing member by interposing the upper sheet of the membrane between them, liquid does not enter the membrane sheet. Further, since the first fixing member has the drain groove formed therein, liquid is discharged outside the first fixing member, and therefore, liquid does not stay in the upper part of the membrane for a long period of time.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 1:
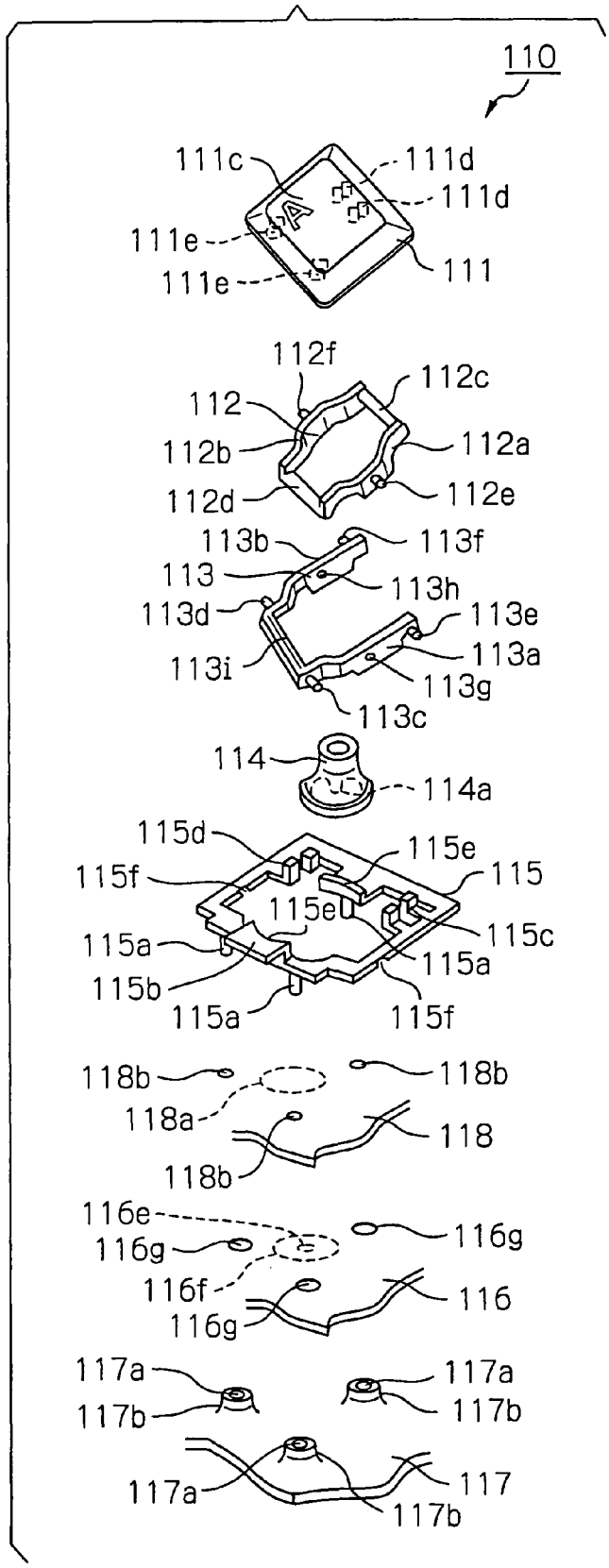
FIG. 1 is an exploded perspective view schematically showing a preferred embodiment of a key switch arrangement according to the present invention.
Figure 2:
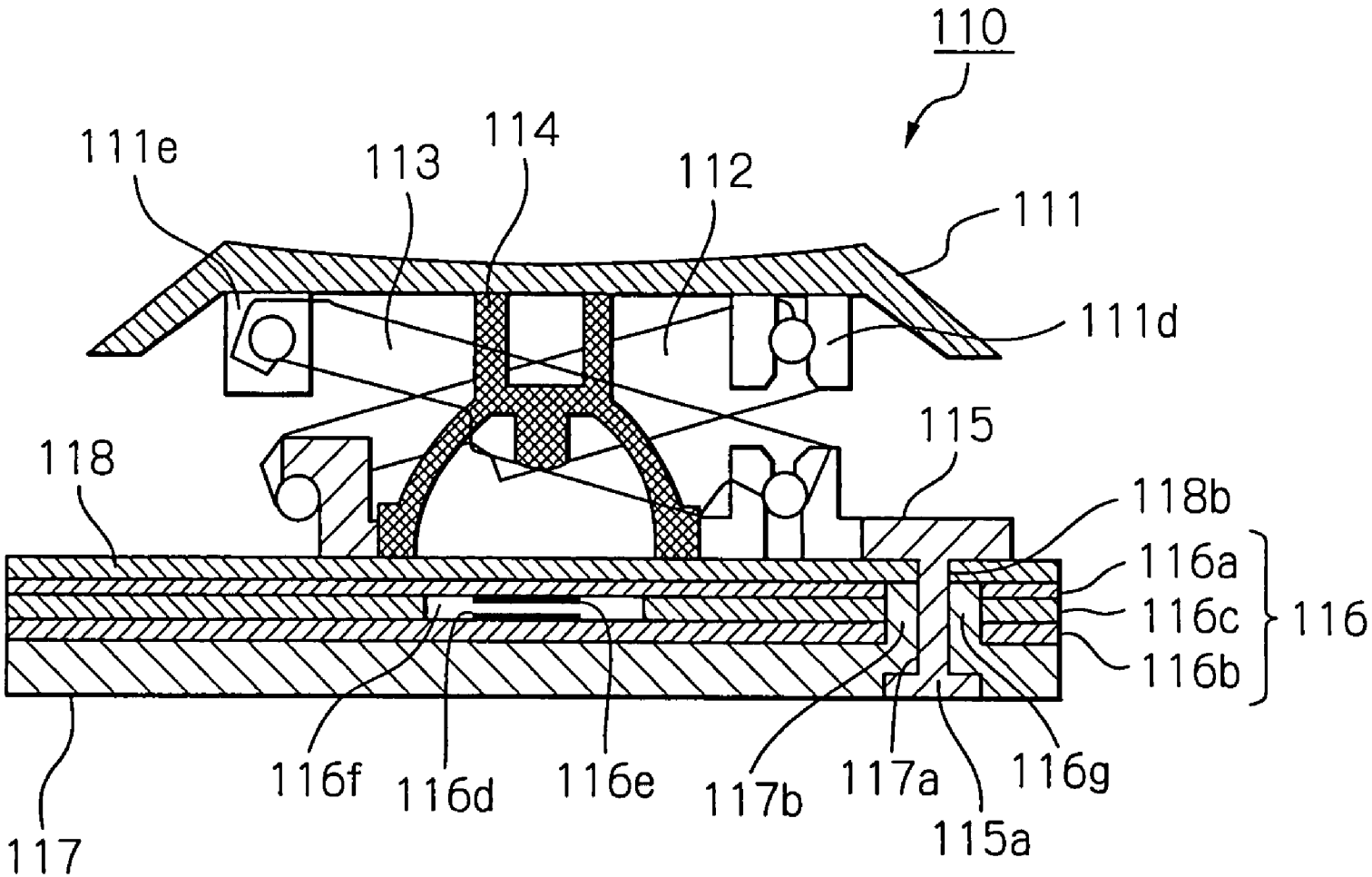
FIG. 2 is a cross-sectional view schematically showing the key switch arrangement shown in FIG. 1.

A preferred embodiment of a key switch arrangement in accordance with the present invention will be described reference to the accompanying drawings. FIG. 1 is an exploded perspective view schematically showing a key switch arrangement of an illustrative embodiment in accordance with the invention, and FIG. 2 is a cross-sectional view schematically showing the key switch arrangement of the illustrative embodiment. In FIG. 2, structural parts and elements like those shown in FIG. 1 are designated by identical reference numerals, and will not repetitively be described in order to avoid redundancy.

In FIGS. 1 and 2, a key switch 110 in accordance with the illustrative embodiment includes a key-top 111, a first link member 112 arranged rotatably against the key-top 111, a second link member 113 arranged slidably against the key-top 111, a rubber dome 114 serving as an elastic member and bendable when the key-top is depressed and restoring the key-top 111 to its original position when the depressing force is released, a holder or fixing member 115 holding the first link member 112 and second link member 113, a waterproof sheet 118 fixed with the holder 115 and arranged in the lower part of the holder 115, a membrane sheet 116 having an electric contact right under the rubber dome 114 via interposition of the waterproof sheet 118, and a back plate or fixing member 117.

On the upper surface of the key-top 111, there is printed a letter, character or symbol 111*c*. On the rear surface of the key-top 111, there are provided rotary supports 111*d* rotatably supporting one end of the first link member 112 and slide supports 111*e* supporting one end of the second link member 113 rotatably and movably in a horizontal direction, which is in parallel with the plane formed by back plate 117. The first link member 112 comprises a pair of legs 112*a*, 112*b*, which have one end provided with a first coupling rod 112*c* inserted into and supported by the rotary supports 111*d* of the key-top 111 in a fashion connecting between the legs 112*a*, 112*b*, and have the other end correspondingly provided with a second coupling rod 112*d* in a fashion connecting between the legs 112*a*, 112*b*. Further, on the respective external surfaces of the legs 112*a*, 112*b*, there are provided shafts 112*e*, 112*f* lying on a line connecting between the first coupling rod 112*c* and the second coupling rod 112*d* and placed in a location at an equal distance from the respective coupling rods 112*c*, 112*d*.

The second link member 113 comprises a pair of legs 113*a*, 113*b*, which have one end provided with first supporting projections 113*c*, 113*d* protruding outward and supported by the slide support 111*e* of the key-top 111 rotatably and movably in parallel in a horizontal direction, and have the other end provided with second supporting projections 113*e*, 113*f* protruding outward and placed in a location at a distance equal to that between the coupling rods 112*c*, 112*d* of the first link member 112. Further, there are provided shaft holes 113*g*, 113*h* lying on a line connecting between the first supporting projections 113*c*, 113*d* and the second supporting projections 113*e*, 113*f* and placed in a location at an equal distance from the respective supporting projections 113*c*, 113*d*; 113*e*, 113*f*. Moreover, the legs 113*a*, 113*b* are connected with a connection 113*i* to each other at the tip side far from the first supporting projections 113*c*, 113*d*.

The rubber dome 114 is made of an elastic material, such as rubber, formed generally in a cup shape which has its internal surface protruding downward at the central part to form a contact depression part 114*a*. The holder 115 is formed into a frame-like shape dedicated for a single key. The holder 115 has its one end, in the vicinity of which there is provided a slide guide 115*b* for supporting the second coupling rod 112*d* of the first link member 112 rotatably and movably in parallel in the horizontal direction, while it has its other end, in the vicinity of which there are provided rotary guides 115*c*, 115*d* for supporting the second projections 113*e*, 113*f* of the second link member 113 in a freely rotatable fashion.

In the central part of the holder 115 there are arranged arcuate guide walls 115*e* in opposition to each other for fixing the circumference of the rubber dome 114, and in the underside of the holder 115 there are welding pins 115*a* having a predetermined length and formed in a plurality of places in a fashion surrounding a through-hole 116*f* of the membrane sheet 116. Also, in the underside of the lower part of the holder 115 there are drain grooves 115*f* formed in a plurality of places. The drain groove 115*f* is arranged to be able to discharge liquid staying in the frame of the holder 115 outside the holder 115.

The membrane sheet 116 is, as shown in FIG. 2, formed of an upper sheet 116*a*, a lower sheet 116*b* and a spacer sheet 116*c* interposed between the upper sheet 116*a* and the lower sheet 116*b* each having flexibility, and the spacer sheet 116*c* is provided with a plurality of through-holes 116*f* corresponding to the plurality of keys. The through-hole 116*f* forms a space between the upper sheet 116*a* and the lower sheet 116*b*, and a fixed contact 116*d* is provided in the lower sheet 116*b* on the side of the back plate 117, while a moving contact 116*e* is provided in the upper sheet 116*a* on the side of the rubber dome 114, so that they are positioned in opposition to each other in the space. The fixed contact 116*d* and the moving contact 116*e* constitute an electric contact. In addition, as shown in FIG. 1, the membrane sheet 116 is provided with a plurality of through-holes 116*g* so as to be placed around the through-holes 116*f*.

Arranged to cover allover the membrane sheet 116 is the waterproof sheet 118, the rear side of which is applied allover the surface thereof with an adhesive, except for a non-gluing portion 118*a* located in a position opposite to the contact of the membrane sheet 116. With this adhesive the waterproof sheet 118 is adhered to the membrane sheet 116. The waterproof sheet 118 is arranged to cover allover the membrane sheet 116. The waterproof sheet 118 is glued on the membrane sheet 116 in size substantially equal to the membrane sheet 116, when the gluing width on the outer circumference of the membrane sheet 116 can be secured sufficiently. In such a case, the lower part of the circumference of the membrane sheet 116 and the upper part of the circumference of the back plate 117 are glued to each other with a double-faced tape.

Formed around the non-gluing portion 18*a* there are welding holes 118*b* in positions opposite to welding pins 115*a* of the holder 115. The welding pins 115*a* are inserted into the welding holes 118*b*, so that the waterproof sheet 118 is welded in a state of being interposed between the holder 115 and embossed parts 117*b* of the back plate 117, which will be described later. The welding holes 118*b* are totally blocked up to be thermally welded and sealed with the holder 115.

The back plate 117 is placed in the lower part to mount thereon the components described above. In the back plate 117, there are formed the embossed parts 117*b* in a plurality of places corresponding to the through-holes 116*g* of the membrane sheet 116. The embossed parts 117*b* have holes 117*a* provided penetratingly for passing the welding pins 115*a* of the holder through them. The height of the embossed part 117*b* is approximately equal to the thickness of the membrane 116. Accordingly, in an assembled state, the top of the embossed part 117*b* closely adheres to the waterproof sheet 118, as shown in FIG. 2.

Subsequently, assembling process will be described. In FIGS. 1 and 2, firstly the membrane sheet 116 is mounted on the back plate 117, and the respective embossed parts 117*b* of the back plate 117 are passed through the through-holes 116*g* of the membrane sheet 116. Then, the waterproof sheet is placed on the membrane sheet 116 in such a way that the welding holes 118*b* match the positions of the holes 117*a* of the embossed parts 117*b* and also the non-gluing portion 118*a* matches the contact of the membrane sheet 116, and they are welded.

From the top thereof, the welding pins 115*a* are inserted into the holes 117*a* of the embossed parts 117*b* through the welding holes 118*b* of the waterproof sheet 118 and thermally welded. The tip, i.e. the lower end, of the welding pin 115*a* is deformed into a flat shape by heating so as to closely adhere and fix the holder 115 and the back plate 117 to each other via interposition of the waterproof sheet 118 and the membrane sheet 116. Thereby, the membrane sheet 16 is perfectly sealed on the underside of the waterproof sheet 118, and thus, liquid will not enter the membrane sheet 116, should it be spilled over the upper part of the waterproof sheet 118.

When liquid is spilled over the waterproof sheet 118 and gets inside the frame of the holder 115, depressing the key-top 111 causes the liquid to be discharged outside the frame of the holder 115 through the drain groove 115*f*. Accordingly, liquid does not stay on the upper part of the contact 116*e* of the membrane sheet 116 for a long period of time.

Subsequently, switch operation will be described. Still with reference to FIG. 2, when the key-top 111 is depressed with an optional load, the key-top moves downward, whereby the rubber dome 114 bends, with the result that a contact depression part 114*a* of the rubber dome 114 presses the contact of the membrane sheet 116 via the waterproof sheet 118, by means of which the switch gets in a state of being closed. Thanks to the first link member 112 and the second link member 113, when any portion of the upper part of the key-top 111 is depressed, the key-top moves downward while keeping itself horizontal, and thus, it is possible to obtain a state of the switch being closed.

As has been described above, according to the illustrative embodiment, since the waterproof sheet 118 is arranged on the membrane sheet 116 to seal all portions of the embossed parts 117*b* of the back plate 117 brought into contact with the membrane sheet 116, liquid, such as water or the like, does not get into the membrane sheet 116, even when the liquid is spilled over the keyboard. Further, when liquid is spilled over the waterproof sheet 118 and enters inside the frame of the holder 115, the entered liquid is discharged out of the frame of the holder 115 through the drain groove 115*f*, and thus, the liquid does not stay on the contact of the membrane sheet 116 for a long period of time.

Figure 3:
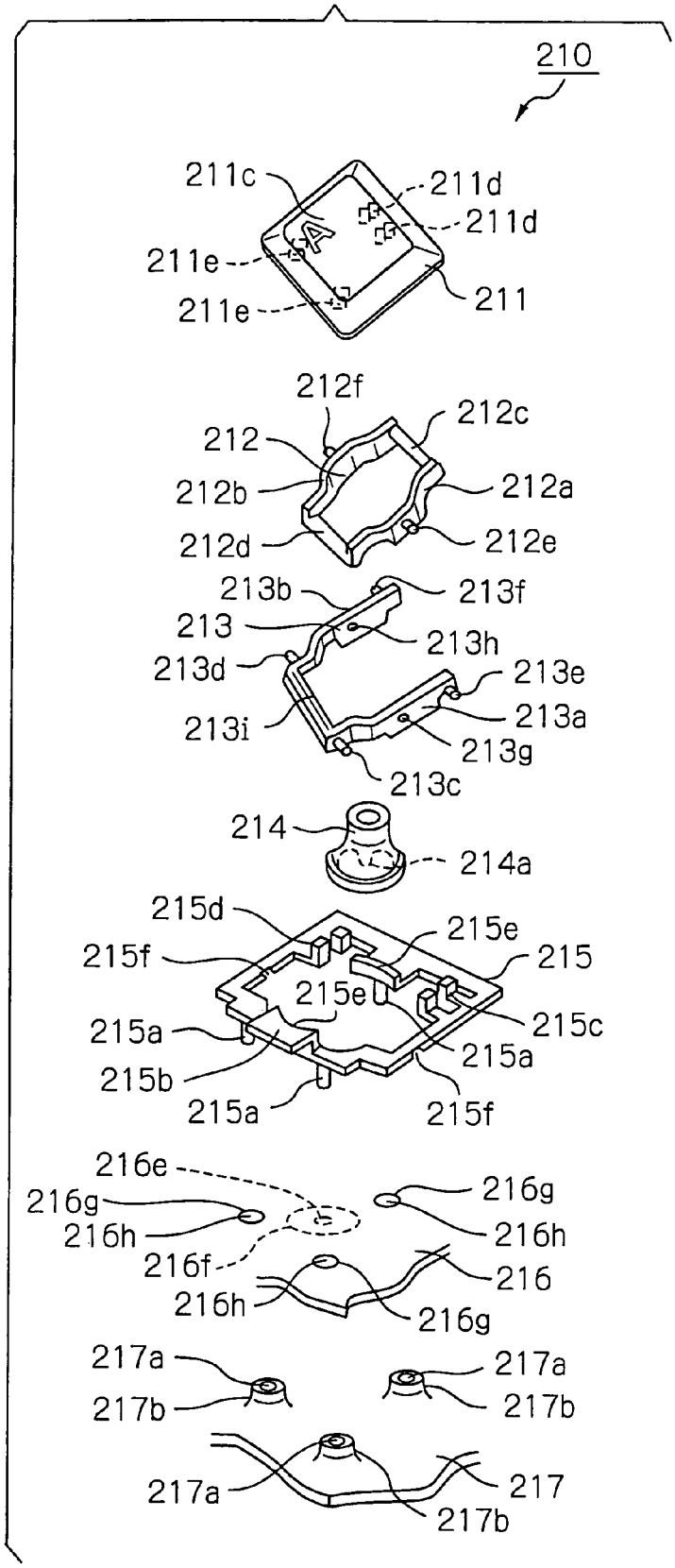
FIG. 3 is an exploded perspective view schematically showing an alternative preferred embodiment of a key switch arrangement according to the present invention.
Figure 4:
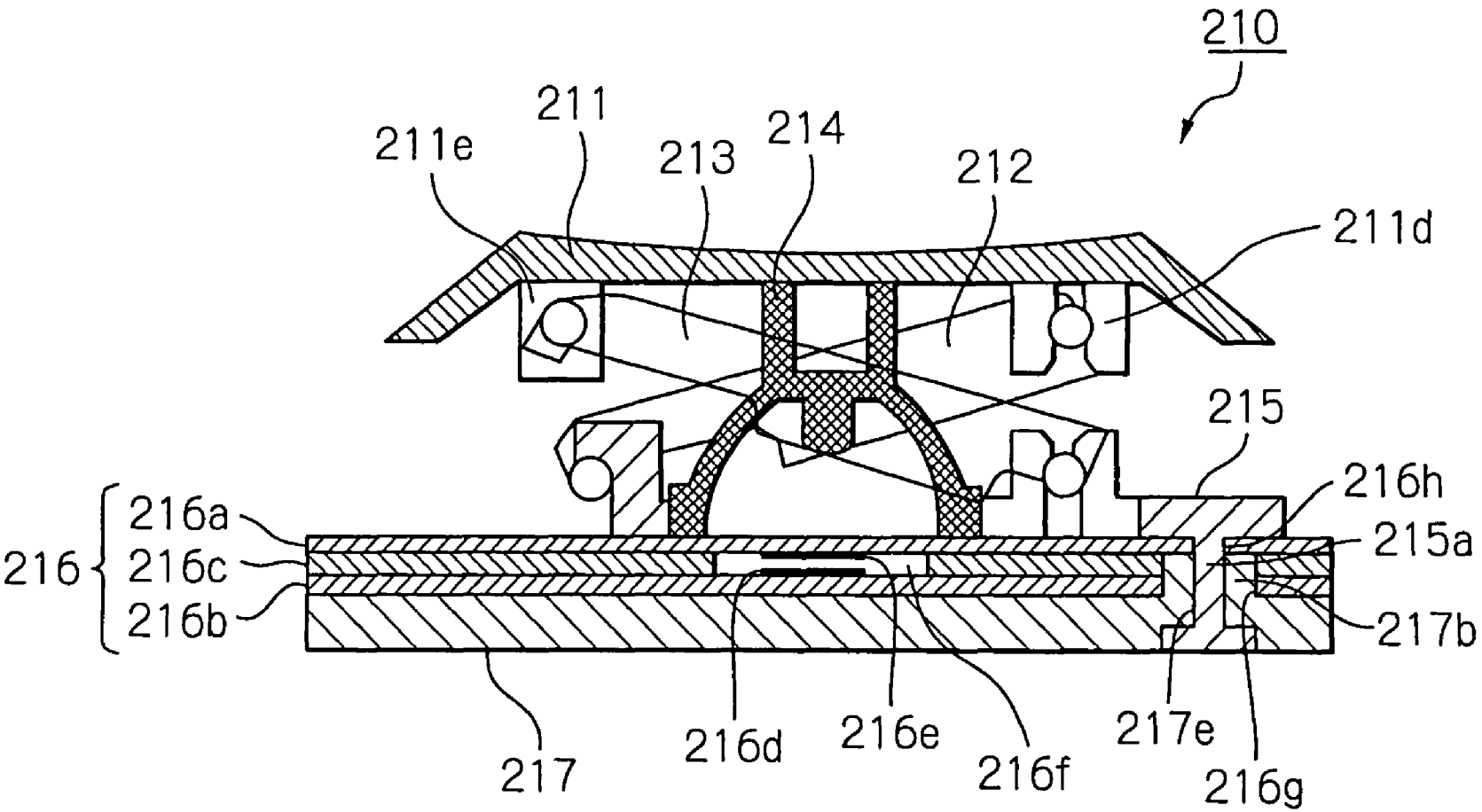
FIG. 4 is a cross-sectional view schematically showing the key switch arrangement shown in FIG. 3.
Figure 5:
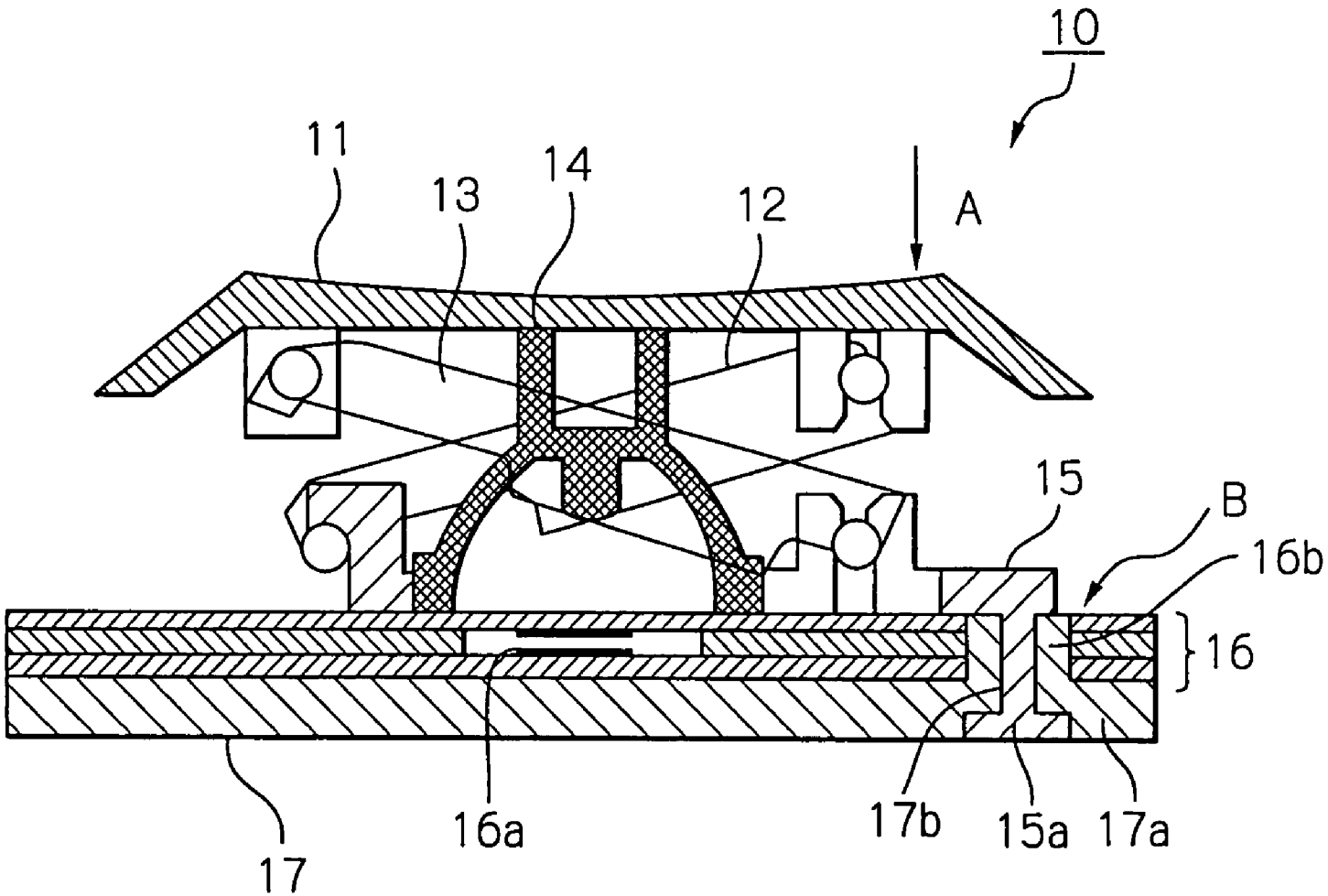
Fig. 5 PRIOR ART
FIG. 5 is a cross-sectional view schematically showing a conventional key switch arrangement.

Next, an alternative embodiment in accordance with the invention will be described. FIG. 3 is an exploded perspective view schematically showing a key switch arrangement of the alternative embodiment, and FIG. 4 is a cross-sectional view schematically showing the key switch arrangement of the alternative embodiment. With reference to FIGS. 3 and 4, a key switch in accordance with the alternative embodiment comprises a key-top 211, a first link member installed rotatably against the key-top 211, a second link member 213 installed slidably against the key-top 211, a rubber dome 214 serving as an elastic member and bendable when the key-top 211 is depressed and restoring the key-top 211 to its original position when the depressing force is released, a holder, or fixing member, 215 for holding the first link member 212 and the second link member 213, a membrane sheet 216 having an electric contact right under the rubber dome 214, and a back plate, or fixing member 217.

Among those components, the key-top 211, the first link member 212, the second link member 213, the rubber dome 214 and the holder 215 may be similar to those of the illustrative embodiment shown in and described with reference to FIGS. 1 and 2, and repetitive description of them will be abbreviated. In addition, the holder 215, like in the embodiment shown in FIGS. 1 and 2, has drain grooves 215*f* formed therein.

The membrane sheet 216 is constituted of, as shown in FIG. 4, an upper sheet 216*a*, a lower sheet 216*b* and a spacer sheet 216*c* interposed between the upper sheet 216*a* and the lower sheet 216*b*, each having flexibility, and the spacer sheet 216*c* is provided with a plurality of through-holes 216*f* corresponding to the plurality of keys. The through-hole 216*f* forms a space between the upper sheet 216*a* and the lower sheet 216*b*, in which space the lower sheet 216*b* on the side of the back plate 217 is provided with a fixed contact 216*d* and the upper sheet 216*a* on the side of the rubber dome 214 is provided with a moving contact 216*e*, in such a way that they are located in opposition to each other. The fixed contact 216*d* and the moving contact 216*e* constitute an electric contact.

Formed in the upper sheet 216*a* of the membrane sheet 216 there are welding holes 216*h* which are sized such that only the welding pins 215*a* of the holder 215 can pass through them. Also, formed in the lower sheet 216*b* and the spacer sheet 216*c*, as shown in FIG. 4, there are through-holes 216*g*, through which embossed parts 217*b* of the back plate 217 pass, which will be described later.

The back plate 217 is arranged in the lower part so as to mount thereon the respective components described above. In the back plate 217 there are formed embossed parts 217*b* in a plurality of places corresponding to the through-holes 216, and the embossed part 217*b* is penetratingly provided with a hole 217*a* for passing the welding pin 215*a* of the holder 215 therethrough. The height of the embossed part 217*b* is approximately equal to the thickness of the lower sheet 216*b* of the membrane sheet 216 being lapped over the spacer sheet 216*c* thereof, i.e. approximately equal to the height of the through-hole 216*g*. Accordingly, in an assembled state, as shown in FIG. 4, the top of the embossed part 217*b* is adhered closely to the underside of the periphery of the welding hole 216*h* of the upper sheet 216*a*, and the position of the hole 217*a* accords with the position of the welding hole 216*h*.

Subsequently, assembling process will be described. In FIGS. 3 and 4, firstly the membrane sheet 216 is mounted on the back plate 217, and the respective embossed parts 217*b* of the back plate 217 are passed through the through-holes 216*g* of the membrane sheet 216. From above, the welding pins 215*a* are inserted into the holes 217*a* of the embossed parts 217*b* through the welding holes 216*h* of the upper sheet 216*c* of the membrane sheet and thermally welded.

The tip, i.e. lower end, of the welding pin 215*a* is deformed into a flat shape by heating so as to closely adhere and fix the holder 215 and the back plate 217 to each other via interposition of the upper sheet 216*a* of the membrane sheet 216. Thereby, the membrane sheet 216 is perfectly sealed on the underside of the upper sheet 216*a*. At this instance, the upper sheet 216*a* is more firmly fixed to the embossed part 217*b* by applying the periphery of the rear side of the welding hole 216*h* of the upper sheet 216*a* with an adhesive.

Should liquid be spilled over the upper part of the membrane sheet 216, it will not enter deeper than the upper sheet 216*a*. Further, should liquid be spilled over the membrane sheet 216 and get inside the frame of the holder 215, depressing the key-top 211 causes the liquid to be discharged outside the frame of the holder 215 through the drain groove 215*f*. Accordingly, the liquid does not stay on the upper part of the contact of the membrane sheet 216 for a long period of time.

As has been described above, in accordance with the alternative embodiment, since the through-hole 216*g* into which the embossed part 217*b* of the back plate 217 is inserted is sealed with the upper sheet 216*a* of the membrane sheet 216 and also the welding hole 216*h* of the upper sheet 216*a* and the welding hole 217*a* of the back plate 217 are sealed with the holder 215, liquid, such as water, does not enter inside the membrane sheet 216, even when the liquid is spilled over the keyboard. Further, when liquid is spilled over the membrane sheet 216 and enters inside the frame of the holder 215, the entered liquid is discharged out of the frame of the holder 215 through the drain groove 215*f*, and thus, the liquid does not stay on the upper part of the contact of the membrane sheet 216 for a long period of time.

The invention is not confined to those embodiments described above, but it may be deformed in various ways. For example, the membrane sheet 116, 216 and a back plate 117, 217 may be constituted of the same material, for example polycarbonate and the like. To constitute the membrane sheet and the back plate from the same material as described above eliminates an occurrence of deflection and the like in the membrane sheet, because the back plate thermally expands correspondingly when the membrane sheet thermally expands. Moreover, an equivalent effect can be obtained, if materials, each having an equivalent thermal expansion coefficient, are used instead of using the same material. Particularly in the alternative embodiment described above, as the upper sheet 216*a* of the membrane sheet 216 is adhered to the embossed part 217*b* of the back plate 217, the effect is of particular note.

The entire disclosure of Japanese patent application No. 2007-306742 filed on Nov. 28, 2007, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A key switch arrangement wherein a key-top is depressable to close an electric contact provided on a membrane sheet, comprising:

a waterproof sheet arranged above said membrane sheet;

a first fixing member arranged above said waterproof sheet and having a first projection protruding toward said waterproof sheet; and a second fixing member arranged below said membrane sheet and having a second projection protruding toward said membrane sheet, each of said waterproof sheet and said second projection having a hole formed which accepts the first projection, said membrane sheet having a hole formed which accepts said second projection, wherein said waterproof sheet closely adheres to a top of said second projection.

2. The arrangement as claimed in claim 1, wherein the hole of said waterproof sheet is welded with said first fixing member for close adhesion.

3. The arrangement as claimed in claim 1, wherein said first fixing member has a drain groove formed for discharging liquid staying on said waterproof sheet.

4. A key switch arrangement wherein a key-top is depressable to close an electric contact provided in a membrane sheet, comprising:

a first fixing member arranged above said membrane sheet and having a first projection protruding toward said membrane sheet; and a second fixing member arranged below said membrane sheet and having a second projection protruding toward said membrane sheet, said membrane sheet comprising an upper sheet, each of said upper sheet and said second protrusion having a hole formed which accepts said first projection, said membrane sheet comprising a spacer sheet and a lower sheet, each of said spacer sheet and said lower sheet having a hole formed which accepts said second projection, wherein said upper sheet adheres closely to a top of said second projection.

5. The arrangement as claimed in claim 4, wherein the hole of said upper sheet is welded with said first fixing membrane for close adhesion.

6. The arrangement as claimed in claim 4, wherein said first fixing member has a drain groove formed for discharging liquid staying on said upper sheet.

* * * * *